US009591922B1

(12) United States Patent
Lee

(10) Patent No.: US 9,591,922 B1
(45) Date of Patent: Mar. 14, 2017

(54) ARCHED SHELF ASSEMBLY

(71) Applicant: Harry Kai Lee, Pomona, CA (US)

(72) Inventor: Harry Kai Lee, Pomona, CA (US)

( * ) Notice: Subject to any disclaimer, the term of this patent is extended or adjusted under 35 U.S.C. 154(b) by 0 days.

(21) Appl. No.: 15/072,188

(22) Filed: Mar. 16, 2016

(51) Int. Cl.

| | |
|---|---|
| ***A47B 3/02*** | (2006.01) |
| ***A47B 43/00*** | (2006.01) |
| ***A47B 47/00*** | (2006.01) |
| ***A47B 96/02*** | (2006.01) |

(52) U.S. Cl.
CPC ..... *A47B 43/00* (2013.01); *A47B 47/00* (2013.01); *A47B 96/02* (2013.01)

(58) Field of Classification Search
CPC ..... A47B 43/00; A47B 47/00; A47B 96/02; A47B 81/06; A47B 3/002
See application file for complete search history.

(56) References Cited

U.S. PATENT DOCUMENTS

| | | | | |
|---|---|---|---|---|
| D539,565 | S * | 4/2007 | Sexton, III | D6/675.3 |
| D595,978 | S * | 7/2009 | Portnoy | D6/675.3 |
| D609,942 | S * | 2/2010 | Sexton | D6/675.3 |
| 8,015,931 | B2 * | 9/2011 | Lin | A47B 43/00 108/115 |
| 8,333,444 | B1 * | 12/2012 | Chang | A47B 43/00 312/258 |
| 8,561,551 | B2 * | 10/2013 | Whalen | A47B 81/00 108/42 |
| 8,985,534 | B1 * | 3/2015 | Hazzard | A47B 81/06 248/176.1 |
| 9,451,824 | B1 * | 9/2016 | Lee | A47B 81/06 |
| 2008/0129003 | A1 * | 6/2008 | Stengel | A47B 81/06 280/47.19 |
| 2008/0164787 | A1 * | 7/2008 | Peng | A47B 43/00 312/108 |
| 2009/0039212 | A1 * | 2/2009 | Whalen | F16M 11/00 248/158 |
| 2011/0011816 | A1 * | 1/2011 | Marietta | A47B 43/00 211/149 |
| 2012/0007484 | A1 * | 1/2012 | Tsai | A47B 43/00 312/262 |

* cited by examiner

*Primary Examiner* — Hanh V Tran

(57) ABSTRACT

An arched shelf assembly provides a pair of arched arms that carries multiple tiers of shelves and disperses forces associated with the load on the shelves. The assembly supports multiple tiers of tempered glass shelves in a stacked, spaced-apart relationship. The shelves are configured to carry a load. The arc shape of the assembly creates enhanced structural integrity by compressing stress forces from the load to the ground. The compression of these stress forces resolves forces into compressive stresses, thereby minimizing tensile stresses on the assembly. In essence, the arc works to transmit the stress forces to the ground. The assembly also pivotally articulates into a collapsed position for enhanced portability, collapsibility, disassembly, and assemblage. To enable hinged articulation, the assembly utilizes hinges, barrel hinges, and buckle hinges that enable hinged articulation of the support frame up to 90° and separation of the components of the assembly.

20 Claims, 9 Drawing Sheets

ARCHED SHELF ASSEMBLY

FIELD OF THE INVENTION

The present invention relates generally to an arched shelf assembly. More so, the arched shelf assembly that provides a unique arched arm having multiple tiers of shelves for carrying a load and dispersing forces associated with the load; whereby the assembly supports multiple tiers of shelves in a stacked, spaced-apart relationship to carry a load; and further supports the load through use of an arc-shaped frame that enhances structural integrity by compressing stress forces to the ground, because instead of pushing straight down, the load on the assembly is carried outward along the curve of the arc portion to a base at each end of the arch, such that the weight is transferred to the base; and further the arc-shape of the frame presents an aesthetic décor; and further, the assembly is configured to hingedly collapse and expand for enhanced portability, collapsibility, disassembly, and assemblage through the use of hinges, barrel hinges, and buckle hinges that enable hinged articulation of the support frame up to 90° and separation of the components of the assembly.

BACKGROUND OF THE INVENTION

Generally, a shelf is a flat horizontal plane which is used in a home, business, store, or elsewhere to hold items of value that are being displayed, stored, or offered for sale. It is raised off the ground and usually anchored/supported on its shorter length sides by brackets. It can also be held up by columns or pillars.

A shelf can be attached to a wall or other vertical surface, be suspended from a ceiling, be a part of a free-standing frame unit, or it can be part of a piece of furniture such as a cabinet, bookcase, entertainment center, some headboards, and so on. Usually two to six shelves make up a unit, each shelf being attached perpendicularly to the vertical or diagonal supports and positioned parallel one above the other. Free-standing shelves can be accessible from either one or both longer length sides. A shelf with a hidden internal bracket is termed a floating shelf.

It is known that a shelf is a type of storage enclosures often used in a number of environments, such as schools, fitness centers, industrial, commercial, and military institutions for storage of items, as books, clothing, shoes, and sporting accessories. One form of a storage assembly is a shelving system that comprises of multiple shelves fastened to a wall or cabinet. A shelf attached to the side walls located has attachments to hang clothing in the locker chamber. Additional shelf space is useful to support items and allow shoes and boots to be placed on the locker floor and separated from other items, such as books, papers and backpacks.

Typically, such shelving systems are often used in homes to store and display clothing, books, food, and tools. Also, shelving systems are used in stores to display items of merchandise generally handled as self-service items. For example, display racks are often used in supermarkets to display cans or bottles of soft drinks, the cans or bottles being removable for purchase by the customer in a self-service manner from the display rack.

In many instances, the shelving system requires compacting for moving. A number of shelves have been developed for this purpose. However, they have the disadvantage that the collapsing of a set-up shelf may be effected by compressing the frame sections bearing the supporting trays or the like so that there is danger of an undesired collapse of the shelf in case one of the frame sections meets a resistance, for example, a threshold between two rooms and/or a wall.

Additionally, during the folding up of this shelf arrangement, one must overcome not only the resistance of a spring, but also the resistance of trunnions guided in partially obliquely oriented guide slots. A further disadvantage resides in the fact that the space requirement for a collapsed shelf of this type is relatively large.

Other proposals have involved efficient load bearing shelves that collapse for stowage and portability. The problem with these devices is that they do not provide a multitier, shelf assembly that uses a pair of arched arms that can efficiently distribute the weight of a load, nor are the hinges for folding the assembly sufficiently detachable and pivotal.

Thus, an unaddressed need exists in the industry to address the aforementioned deficiencies and inadequacies. Even though the above cited shelving systems meet some of the needs of the market, a shelf assembly having a unique arched arm that carries multiple tiers of shelves and disperses forces associated with the load on the shelves is still desired.

SUMMARY OF THE INVENTION

The present invention is directed to an arched shelf assembly that provides multiple tiers of shelves for carrying a load and a pair of arched arms for dispersing forces associated with the load. The arched shelf assembly, hereafter, "assembly", supports multiple tiers of shelves in a stacked, spaced-apart relationship. The shelves are configured to carry a load. The assembly is unique in that it is configured into an arc-shaped frame. The arc shape of the assembly creates enhanced structural integrity by compressing stress forces from the load to the ground. The compression of these stress forces resolves forces into compressive stresses, thereby minimizing tensile stresses on the assembly. In essence, the arc works to transmit the stress forces to the ground. Also, the arc-shape is pronounced in the assembly, thereby presenting an aesthetic décor.

The assembly pivotally collapses for enhanced portability, collapsibility, disassembly, and assemblage. To enable this hinged articulation, the assembly utilizes at least one hinge, at least one barrel hinge, and at least one buckle hinge that enable hinged articulation of the assembly up to 90°, and also restrict the pivotal articulation to lock the assembly into an expanded, operational position.

In some embodiments, the assembly may include elongated legs, a pair of arched arms, a pair of vertical shafts, and a support frame that pivotally interconnect with a variety of hinges to form the assembly. These components are configured to hingedly interconnect through at least one hinge and at least one buckle hinge for efficient manipulation of the assembly between an expanded position and a collapsed position.

It is significant to note that the use of a buckle hinge is unique in that it enables both pivoting and partial detachment for the components of the assembly. Thus, the buckle hinge enables the legs, a pair of arched arms, a pair of vertical shafts, and a support frame to be pivoted up to 90°. The buckle hinge also uses a buckling mechanism, described below, to restrict pivotal articulation, and thus lock the assembly into the expanded position. Furthermore, a first shelf, a second shelf, and a third shelf are arranged in a tiered relationship to support a load. The shelves are detachable from the assembly.

In some embodiments, the assembly comprises a first leg having a pair of first leg ends. A second leg having a pair of second leg ends is disposed in a generally spaced-apart, parallel relationship with the first leg. The legs are generally linear.

In some embodiments, the assembly comprises a pair of arched arms. The pair of arched arms are arranged in a generally spaced-apart, parallel relationship. The pair of arched arms are defined by an arc portion having a generally arc shape. The arc portion is defined by a base end and a shelf end. The arched arms are further defined by a base portion having a generally linear shape. The base portion comprises a first end and a second end.

The arc shape of the arc portion enables stress forces to be transmitted towards the base portion, so as to enhance the structural integrity of the assembly. The arc shape of the arched arms is efficacious for supporting a load on the assembly. This is because instead of pushing straight down, the load on the assembly is carried outward along the curve of the arc portion to the base portion at each end of the arched arms. In essence, the weight is transferred to the base portion at either end.

In some embodiments, the first end of the base portion is configured to fixedly join with the base end of the arc portion of the pair of arched arms. Also, the first end and the second end of the base portion are configured to pivotally join with the pair of first leg ends and the pair of second leg ends. In this manner, the pair of arched arms pivot between a lengthwise coplanar orientation and a generally perpendicular orientation relative to the first leg and the second leg. The lengthwise coplanar orientation forms the collapsed position. The generally perpendicular orientation forms the expanded position. Furthermore, at least one tab extend from the arc portion of the pair of arched arms. The tab is utilized to support a second shelf, as described below.

In some embodiments, the assembly comprises a pair of vertical shafts. The pair of vertical shafts are arranged in a generally spaced-apart, parallel relationship. The vertical shafts are defined by a first shaft end and a second shaft end. The first shaft end is configured to fixedly join with the first leg.

In other embodiments, the pair of vertical shafts are further defined by a hinged area that is disposed approximately centrally between the first shaft end and the second shaft end. The hinged area is configured to enable pivoting articulation between the first shaft end and the second shaft end. In this manner, the vertical shafts are configured to pivot between a traversal coplanar orientation and a generally perpendicular orientation relative to the first leg and the second leg. The traversal coplanar orientation forms the collapsed position. The generally perpendicular orientation forms the expanded position.

In some embodiments, the assembly comprises a support frame. The support frame is defined by a pair of frame rods, a narrow end, and a wide end that fixedly join together to form a substantially A-shape. The narrow end and the wide end are configured to be generally perpendicular to the pair of frame rods. The narrow end is configured to be generally shorter than the wide end.

The narrow end of the support frame pivotally joins with the second shaft end of the pair of vertical shafts. The wide end of the support frame detachably attaches to the shelf end of the arc portion for the pair of arched arms. At least one fastener detachably attaches the wide end of the support frame to the shelf end of the arc portion of the pair of arched arms. In some embodiments, a cross bar extends across the pair of frame rods of the support frame. The cross bar is configured to enhance structural integrity of the support frame.

The assembly utilizes a variety of hinges to enable pivotal articulation, and thereby collapsibility and expansion of the assembly. In one embodiment at least one hinge is used for pivotal interconnectivity. The at least one hinge is defined by a first hinge side that is configured to pivotally join with a second hinge side. The at least one hinge pivotally connects the hinged area of the pair of vertical shafts. The at least one hinge also pivotally connects the narrow end of the support frame with the second shaft end of the pair of vertical shafts.

In one embodiment at least one barrel hinge is used for pivotal interconnectivity at the base portion of the arched arms. The barrel hinge is defined by a first barrel side that pivotally joins with a second barrel side. The barrel hinge is configured to pivotally connect the first end and the second end of the base portion with the pair of first leg ends and the pair of second leg ends for the respective legs.

In some embodiments, the buckle hinge pivotally connects the first shaft end with the second shaft end of the vertical shafts. The buckle hinge selectively enables and restricts pivotal articulation between the first shaft end and the second shaft end.

In some embodiments, the buckle hinge pivotally connects the pair of first leg ends with the base end of the arched arms. The buckle hinge is further configured to selectively enable and restrict pivotal articulation between the pair of first leg ends and the base end of the arched arms.

The buckle hinge provides unique interconnectivity between the legs and arched arms by enabling the pivotal articulation from a free positon, and inhibiting the pivotal articulation from a locked position. Specifically, the buckle hinge is used to fasten, connect, and pivot multiple sections of the assembly relative to each other. In one embodiment, the buckle hinge pivotally connects the arched arms with the legs. In addition to the hinging function, the buckle hinge is further configured to restrict pivotal articulation. Thus, the assembly can be locked into the expanded position for enhanced structural integrity, or unlocked into the collapsed position.

This unique capacity of the buckle hinge to both enable and restrict pivotal articulation is possible because of the buckling mechanism. Specifically, the buckle hinge is defined by a lip and a latching member. The latching member comprises a mounting panel, a lever, and a catch. The lever is configured to pivotally engage the catch to the lip, wherein the lip and the latching member detach and fasten through selective manipulation of the lever.

In some embodiments, the assembly provides multiple, tiered surfaces for supporting a load. A first shelf detachably positions on the support frame. A second shelf detachably positions on the at least one tab of the arc portion of the pair of arched arms. A third shelf detachably positions on the base portion of the pair of arched arms. The shelves may be fabricated from tempered glass. Though other materials may be used.

In operation of collapsing the assembly, the first step involves unlocking the buckle hinge to enable pivotal articulation of the arched arms about the legs. The hinges and barrel hinges are also pivotally articulated at the arched arms, vertical shafts, and the support frame. These components may then be folded inwardly to create the collapsed, substantially flat configuration of the assembly. The assembly is opened to an expanded positon by unfolding the arched arms, vertical shafts, and support frame, and locking the buckle hinge.

Thus, the assembly is specially configured so that the arched arms, vertical shafts, and the support frame are pivotally connected together so that they may be quickly assembled and also disassembled and returned to the collapsed position for further storage or shipment.

One objective of the present invention is to provide an arched shelf assembly for carrying a load on multiple tiered shelves Another objective is to disperse the tensile forces from the load through an arc shape.

Another objective is to provide an arched shelf assembly that utilizes at least one buckle hinge to fold, lock, and interconnect different sections of the assembly, such that configuration between a collapsed position and an expanded position is possible.

Another objective is to provide a cross bar that extends transversely through the support frame to enhance overall lateral stability.

Another objective is to provide three tiers of shelves for enhanced support functionality and aesthetic appearance.

Another objective is to provide a greater level of portability for an arched shelf assembly for moving and storage.

Yet another objective is to enable fast collapsing for stowage without requiring tools.

Yet another objective is to detachably attach three shelves to the arched shelf assembly in a tiered configuration.

Yet another objective is to provide a cost effective arched shelf assembly that is stable enough to support heavy loads, yet also configurable to easily collapse for stowage.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 6A is an elevated side view, FIG. 6B is a perspective view, FIG. 6C is a top view, and FIG. 6D is a lengthwise view, in accordance with an embodiment of the present invention;

Like reference numerals refer to like parts throughout the various views of the drawings.

DETAILED DESCRIPTION OF THE INVENTION

Figure 1:
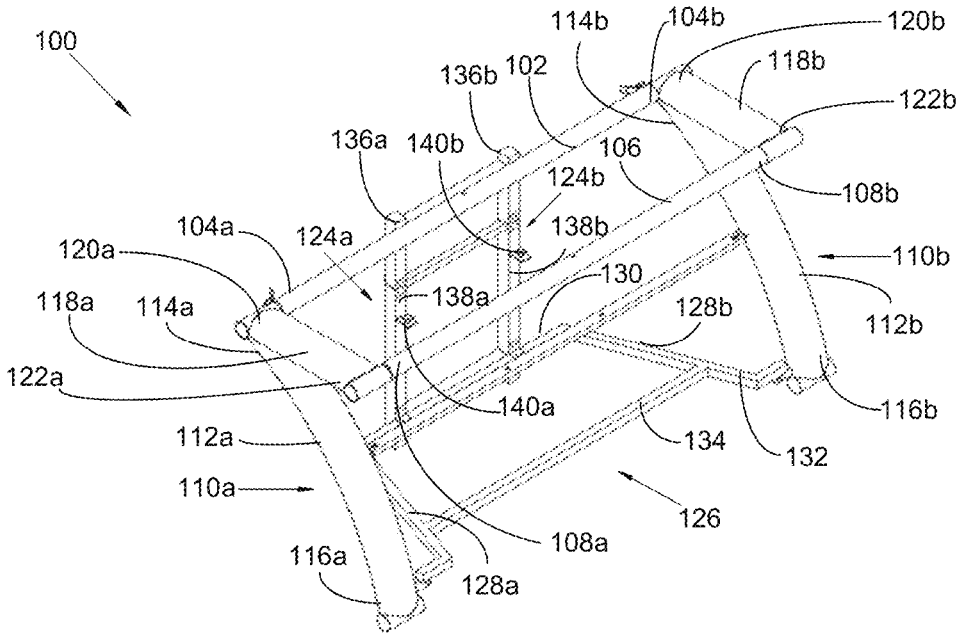
FIG. 1 illustrates a top perspective view of an exemplary arched shelf assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-10B, an arched shelf assembly 100 provides multiple tiers of shelves 148, 150, 152 for carrying a load and a pair of arched arms 110*a*, 110*b* for dispersing forces associated with the load. In some embodiments, the arched shelf assembly 100, hereafter "assembly 100", utilizes various hinges 142*a*, 144*a*, 146*a* to enable and restrict pivotal articulation for collapsing and expanding the assembly 100. Further, the assembly supports multiple tiers of shelves 148, 150, 152 in a stacked, spaced-apart relationship. The shelves 148, 150, 152 are configured to carry a load. The load may include, without limitation, books, a television, tools, plants, food, drink, pictures, computers, and any number of eclectic objects.

Those skilled in the art will recognize that the assembly 100 is unique in that it is configured into an arc shape. The arc shape of the assembly 100 creates enhanced structural integrity by compressing stress forces from the load to the ground. The compression of these stress forces resolves forces into compressive stresses, thereby minimizing tensile stresses on the assembly. In essence, the arc works to transmit the stress forces to the ground. Also, the arc-shape is pronounced in the assembly 100, thereby presenting an aesthetic décor.

As illustrated in FIG. 1, the assembly 100 pivotally collapses for enhanced portability, collapsibility, disassembly, and assemblage. To enable this hinged articulation, the assembly 100 utilizes at least one hinge 144*a-d*, at least one barrel hinge 146*a-d*, and at least one buckle hinge 142*a-d* that enable hinged articulation of the assembly 100 up to 90°, and also restrict the pivotal articulation to lock the assembly 100 into an expanded, operational position.

Figure 2:
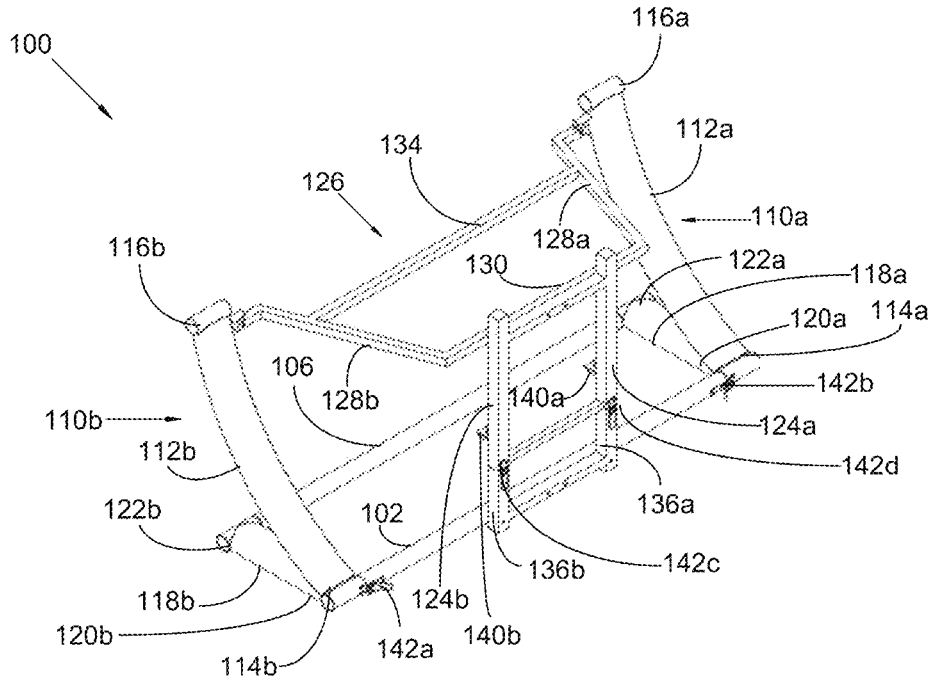
FIG. 2 illustrates a bottom perspective view of the arched shelf assembly, in accordance with an embodiment of the present invention.

Looking at FIG. 2, the assembly 100 may include elongated legs 102, 106, a pair of arched arms 110*a*, 110*b*, a pair of vertical shafts 124*a*, 124*b*, and a support frame 126. These components pivotally interconnect with a variety of hinges 142*a*, 144*a*, 146*a* to form the assembly 100. These components are configured to pivotally interconnect through at least one hinge 144*a-d*, at least one barrel hinge 146*a-d*, and at least one buckle hinge 142*a-d* for efficient manipulation of the assembly 100 between an expanded position and a collapsed position.

It is significant to note that the use of a buckle hinge 142*a* is unique in that it enables both pivoting and partial detachment for the components of the assembly 100. Thus, the buckle hinge enables the legs 102, 106, a pair of arched arms 110*a*, 110*b*, a pair of vertical shafts 124*a*, 124*b*, and a support frame 126 to be pivoted up to 90°. The buckle hinge 142*a* also uses a buckling mechanism, described below, to restrict pivotal articulation, and thus lock the assembly 100 into the expanded position. Furthermore, a first shelf 148, a second shelf 150, and a third shelf 152 are arranged in a tiered relationship to support a load. The shelves 148, 150, 152 are detachable from the assembly 100.

Figure 3:
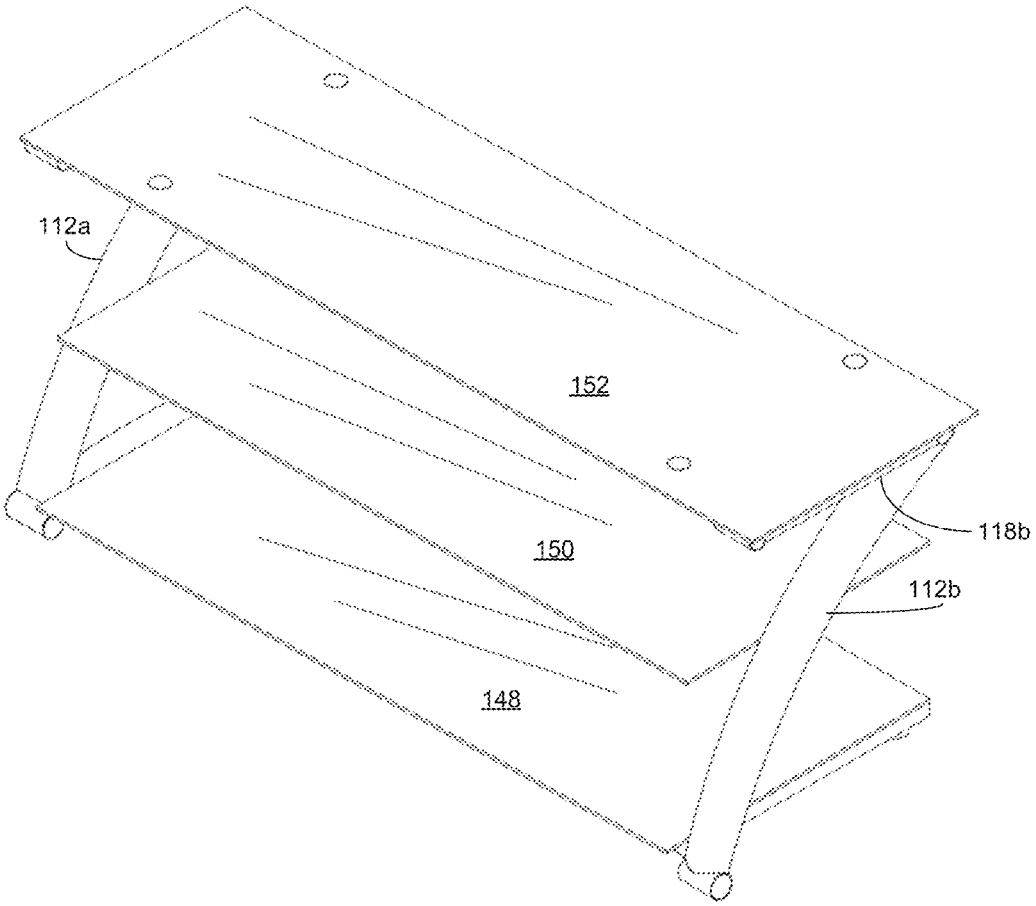
FIG. 3 illustrates a perspective view of the arched shelf assembly with a first shelf, a second shelf, and a third shelf arranged in a tiered configuration, in accordance with an embodiment of the present invention.

In one possible embodiment shown in FIG. 3, the assembly 100 may have a generally trapezoidal shape when viewed from above, and a wide base for supporting the weight of a heavy load. Though, the assembly 100 may also take other shapes when viewed from above, such as, a rhombus, a cube, a pyramid, an oval, or a rectangle. Suitable materials for the assembly 100 may include, without limitation, steel, aluminum, metal, metal alloys, wood, fiberglass, rigid polymers, bamboo, and cardboard.

In some embodiments, the assembly 100 comprises a first leg 102 having a pair of first leg ends 104*a*, 104*b*. A second leg 106 having a pair of second leg ends 108*a*, 108*b* is disposed in a generally spaced-apart, parallel relationship with the first leg 102. The legs 102, 106 are generally linear and sufficiently rigid to form a stable foundation for the assembly 100.

Figure 4:
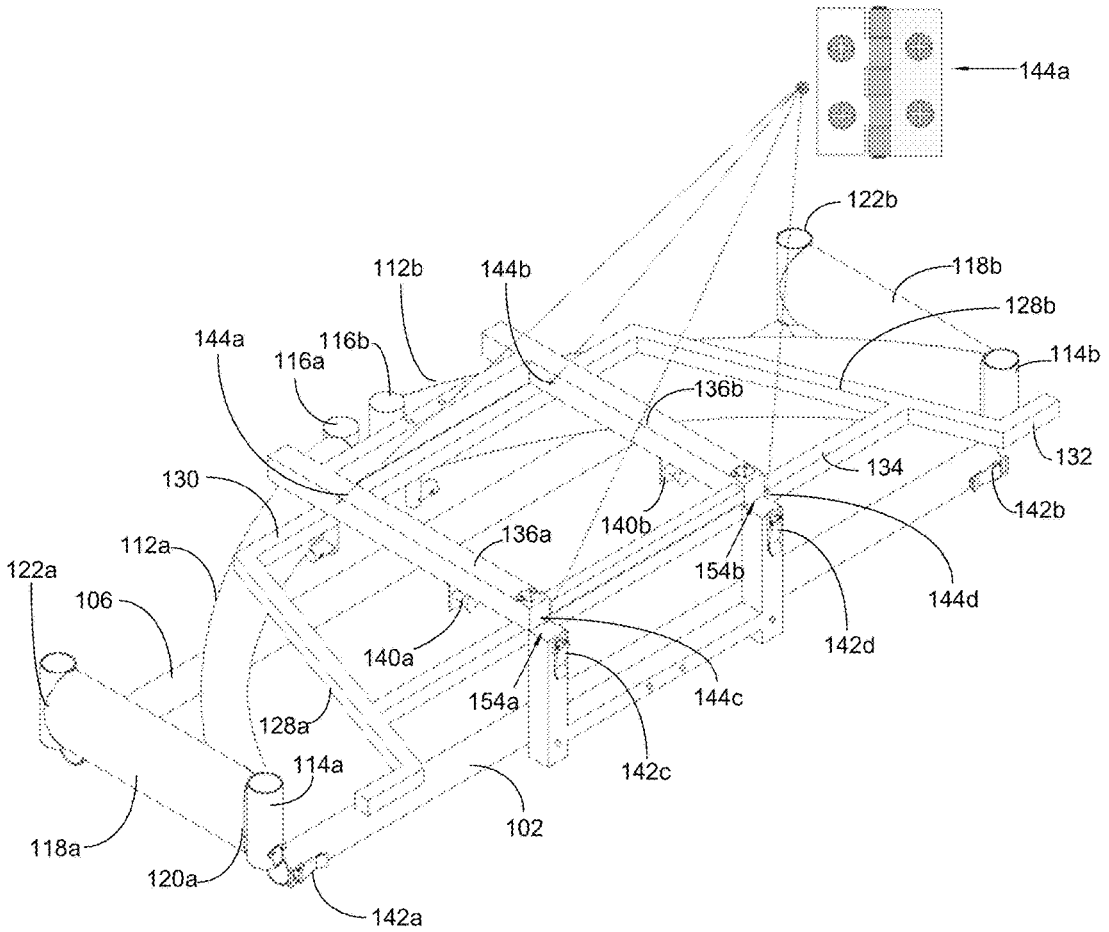
FIG. 4 illustrates a top view of the arched shelf assembly in a partially collapsed position, and at least one hinge for the pivotal articulation of the pair of vertical shafts, in accordance with an embodiment of the present invention.

As illustrated in FIG. 4, the assembly 100 comprises a pair of arched arms 110*a*, 110*b*. The pair of arched arms 110*a*, 110*b* are arranged in a generally spaced-apart, parallel relationship. The pair of arched arms 110*a*, 110*b* are defined by an arc portion 112*a*, 112*b* having a generally arc shape.

The arc portion 112*a*, 112*b* is defined by a base end 114*a*, 114*b* and a shelf end 116*a*, 116*b*. The arched arms 110*a*, 110*b* are further defined by a base portion 118*a*, 118*b* having a generally linear shape. The base portion 118*a*, 118*b* comprises a first end 120*a*, 120*b* and a second end 122*a*, 122*b*. The arc shape of the arc portion 112*a*, 112*b* enables stress forces to be transmitted towards the base end 114*a*, 114*b*, so as to enhance the structural integrity of the assembly 100.

As described above, the arc shape of the arched arms 110*a*, 110*b* is efficacious for supporting a load on the assembly 100. This is because instead of pushing straight down, the load on the assembly 100 is carried outward along the curve of the arc portion 112*a*, 112*b* to the base portion 118*a*, 118*b* at each end of the arched arms 110*a*, 110*b*. In essence, the weight is transferred to the base portion 118*a*, 118*b* at either end.

In some embodiments, the first end 120*a*, 120*b* of the base portion 118*a*, 118*b* is configured to fixedly join with the base end 114*a*, 114*b* of the arc portion 112*a*, 112*b* of the pair of arched arms 110*a*, 110*b*. Also, the first end 120*a*, 120*b* and the second end 122*a*, 122*b* of the base portion 118*a*, 118*b* are configured to pivotally join with the pair of first leg 102 ends and the pair of second leg ends. In this manner, the pair of arched arms 110*a*, 110*b* pivot between a lengthwise coplanar orientation and a generally perpendicular orientation relative to the first leg 102 and the second leg. The lengthwise coplanar orientation forms the collapsed position. The generally perpendicular orientation forms the expanded position. Furthermore, at least one tab 168 extend from the arc portion 112*a*, 112*b* of the pair of arched arms 110*a*, 110*b*. The tab 168 is utilized to help support a second shelf 150, as described below.

The assembly 100 further comprises a pair of vertical shafts 124*a*, 124*b*. The vertical shafts 124*a*, 124*b* are arranged in a generally spaced-apart, parallel relationship. The vertical shafts 124*a*, 124*b* are defined by a first shaft end 136*a*, 136*b* and a second shaft end 138*a*, 138*b*. The first shaft end 136*a*, 136*b* is configured to fixedly join with the first leg 102.

Figure 5:
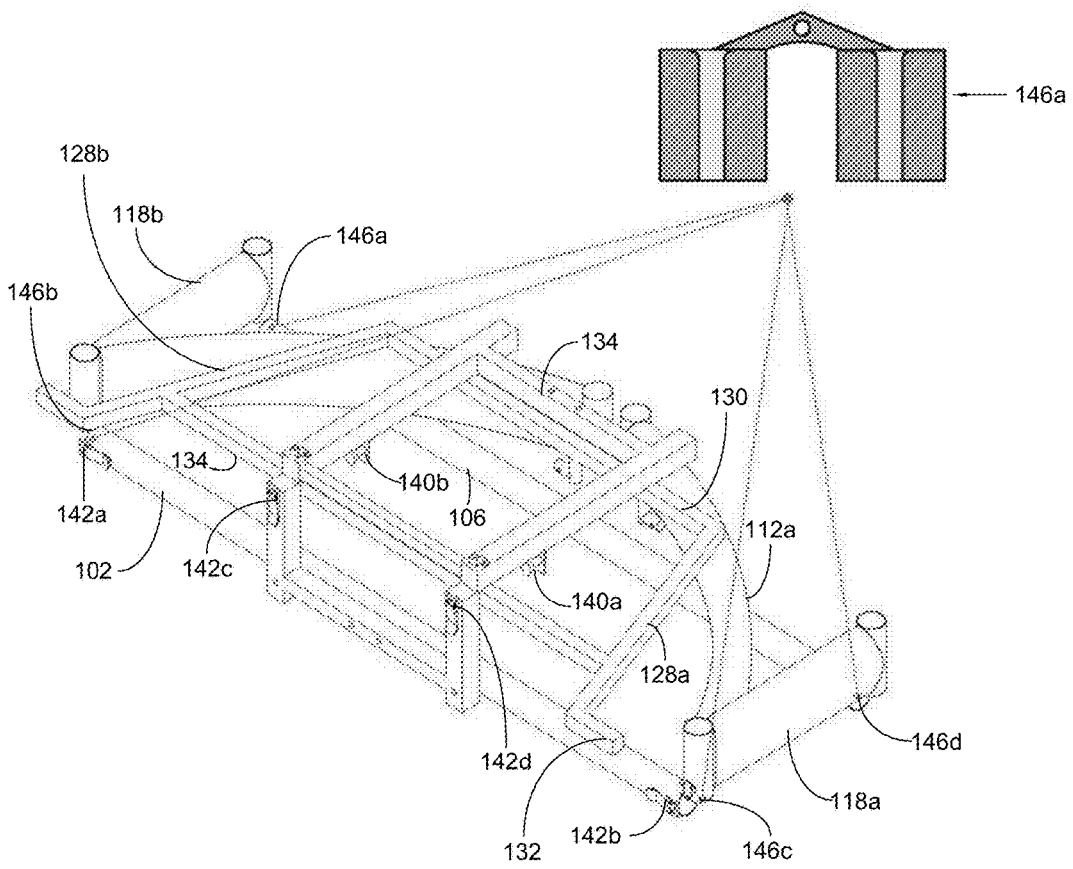
FIG. 5 illustrates a top view of the arched shelf assembly in a partially collapsed position, and at least one barrel hinge for the pivotal articulation of the pair of arched arms, in accordance with an embodiment of the present invention.

In FIG. 5, the vertical shafts 124*a*, 124*b* are shown folded at a hinged area 154*a*, 154*b* between the first shaft end 136*a*, 136*b* and the second shaft end 138*a*, 138*b*. The hinged area 154*a*, 154*b* is disposed approximately centrally between the first shaft end 136*a*, 136*b* and the second shaft end 138*a*, 138*b*. The hinged area 154*a*, 154*b* is configured to enable pivoting articulation between the first shaft end 136*a*, 136*b* and the second shaft end 138*a*, 138*b*. In this manner, the vertical shafts 124*a*, 124*b* are configured to pivot between a traversal coplanar orientation and a generally perpendicular orientation relative to the first leg 102 and the second leg. The traversal coplanar orientation forms the collapsed position. The generally perpendicular orientation forms the expanded position.

In one embodiment, at least one protrusion 140*a*, 140*b* extends from the pair of vertical shafts 124*a*, 124*b*. The at least one protrusion 140*a*, 140*b* helps support the second shelf 150, as described below. Thus, the second shelf 150 may rest on both the tab 168 of the arched arms 110*a*, 110*b* and the protrusion 140*a*, 140*b* of the vertical shafts 124*a*, 124*b*.

In some embodiments, the assembly 100 comprises a support frame 126. The support frame 126 is defined by a pair of frame rods 128*a*, 128*b*, a narrow end 130, and a wide end 132 that fixedly join together to form a substantially A-shape. The narrow end 130 and the wide end 132 are configured to be generally perpendicular to the pair of frame rods 128*a*, 128*b*. The narrow end 130 is configured to be generally shorter than the wide end 132. In some embodiments, a cross bar 134 extends across the pair of frame rods 128*a*, 128*b* of the support frame 126. The cross bar 134 is configured to enhance structural integrity of the support frame 126.

Figure 10A:
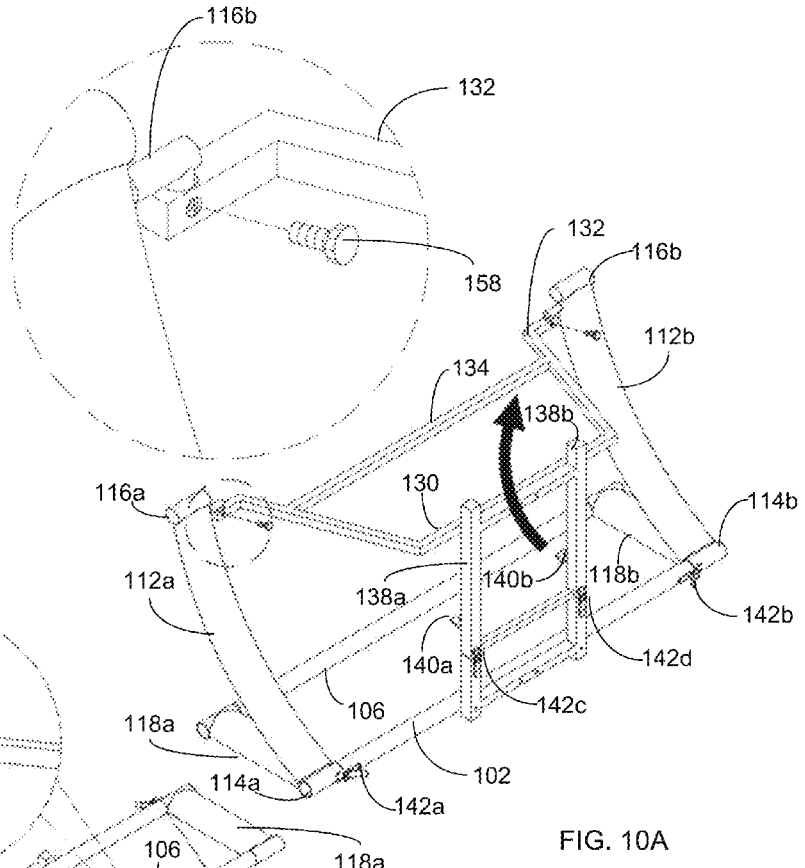
FIGS. 10A and 10B illustrate a perspective view of the arched shelf assembly with the support frame pivotally articulating from a collapsed position to an expanded position, and detachably attaching to the pair of arched arms with at least one fastener, in accordance with an embodiment of the present invention.
Figure 10B:
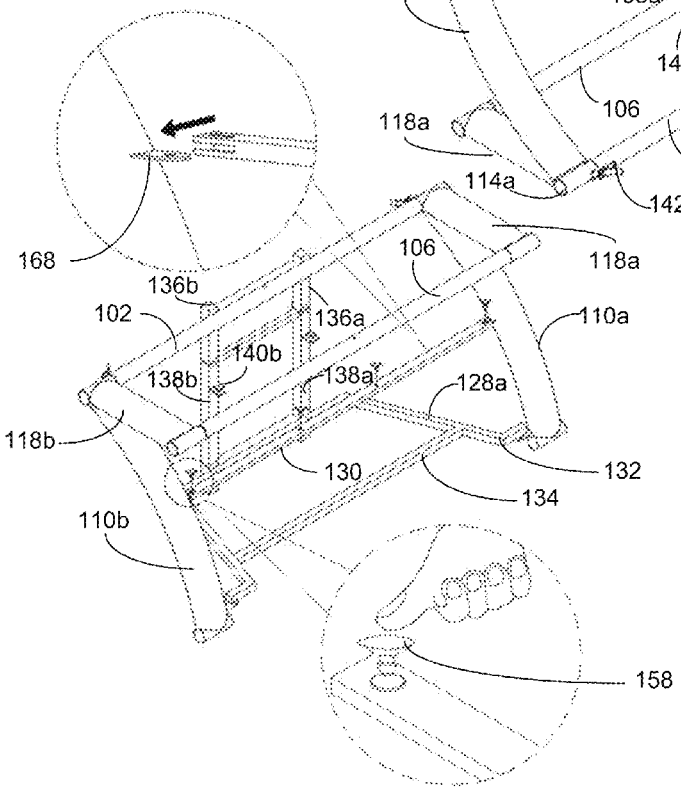

In one possible embodiment shown in FIG. 5, the narrow end 130 of the support frame 126 pivotally joins with the second shaft end 138*a*, 138*b* of the pair of vertical shafts 124*a*, 124*b*. The wide end 132 of the support frame 126 detachably attaches to the shelf end 116*a*, 116*b* of the arc portion 112*a*, 112*b* of the pair of arched arms 110*a*, 110*b*. As FIGS. 10A and 10B show, at least one fastener 158 detachably attaches the wide end 132 of the support frame 126 to the shelf end 116*a*, 116*b* of the arc portion 112*a*, 112*b* of the pair of arched arms 110*a*, 110*b*. The fastener 158 may include, without limitation, a screw knob, a screw, a nail, a magnet, a pin, and an adhesive.

The assembly 100 utilizes a variety of hinges 142*a*, 144*a*, 146*a* to enable pivotal articulation, and thereby collapsibility and expansion of the assembly 100. In one embodiment at least one hinge 144*a-d* is used for pivotal interconnectivity. The at least one hinge 144*a-d* is defined by a first hinge side that is configured to pivotally join with a second hinge side. In one embodiment, the at least one hinge 144*a-d* pivotally connects the hinged area 154*a*, 154*b* of the pair of vertical shafts 124*a*, 124*b*. The at least one hinge 144*a-d* also pivotally connects the narrow end 130 of the support frame 126 with the second shaft end 138*a*, 138*b* of the pair of vertical shafts 124*a*, 124*b*.

Figure 6A:
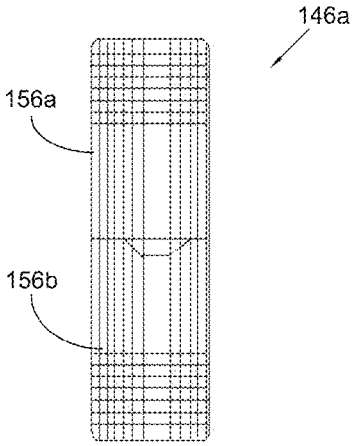
FIGS. 6A, 6B, 6C, and 6D illustrate multiple views of an exemplary barrel hinge having a first barrel side and a second barrel side, where
Figure 6B:
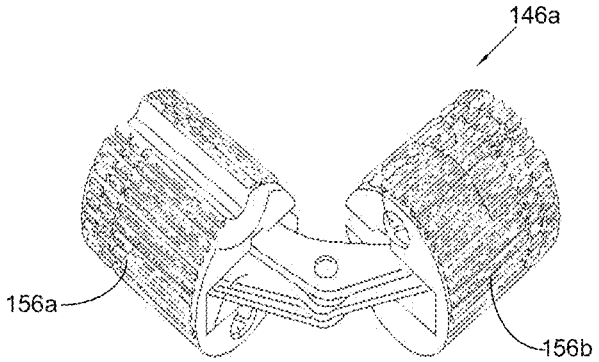
Figure 6C:
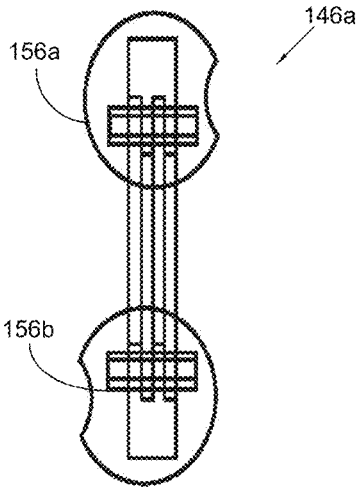
Figure 6D:
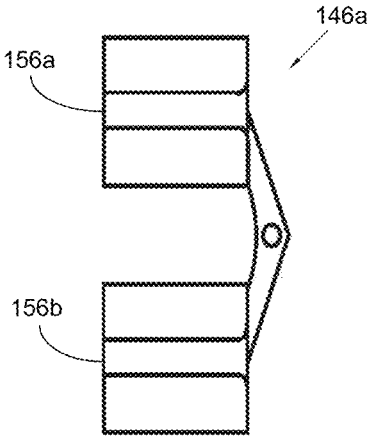

Looking at FIG. 5, at least one barrel hinge 146*a-d* is used for pivotal interconnectivity at the base portion 118*a*, 118*b* of the arched arms 110*a*, 110*b*. The barrel hinge 146*a-d* is defined by a first barrel side that pivotally joins with a second barrel side. The barrel hinge 146*a-d* is configured to pivotally connect the first end 120*a*, 120*b* and the second end 122*a*, 122*b* of the base portion 118*a*, 118*b* with the first leg ends 104*a-b* and the second leg ends 108*a-b* for the respective legs 102, 106. FIGS. 6A, 6B, 6C, and 6D illustrate various views of an exemplary barrel hinge having a first barrel side 156*a* and a second barrel side 156*b*, where FIG. 6A is an elevated side view, FIG. 6B is a perspective view, FIG. 6C is a top view, and FIG. 6D is a lengthwise view of the barrel hinge.

Figure 7:
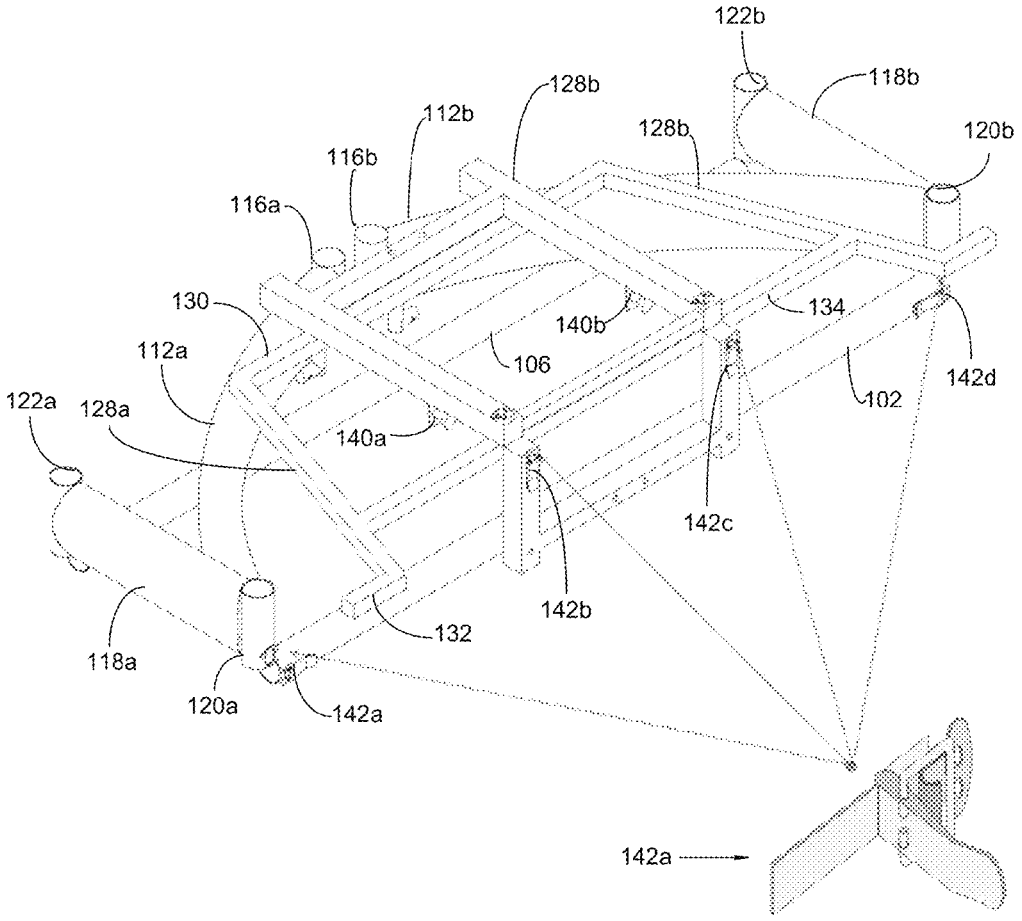
FIG. 7 illustrates a top view of the arched shelf assembly in a partially collapsed position, and at least one buckle hinge for the pivotal articulation of the pair of vertical shafts, in accordance with an embodiment of the present invention.

As FIG. 7 illustrates, a buckle hinge 142*a-d* pivotally connects the first shaft end 136*a*, 136*b* with the second shaft end 138*a*, 138*b* of the vertical shafts 124*a*, 124*b*. The buckle hinge 142*a-d* selectively enables and restricts pivotal articulation between the first shaft end 136*a*, 136*b* and the second shaft end 138*a*, 138*b*. The buckle hinge 142*a-d* utilizes a buckling mechanism to enable this selective pivotal articulation.

Figure 8A:
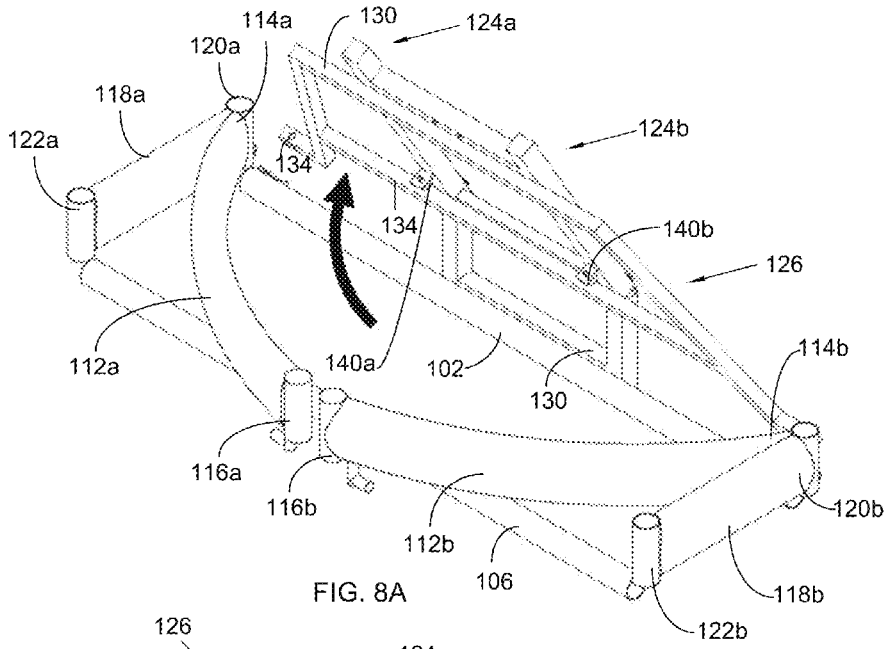
FIGS. 8A and 8B illustrate a perspective view of the arched shelf assembly with the pair of vertical shafts pivotally articulating from a collapsed position to an expanded position, in accordance with an embodiment of the present invention.
Figure 8B:
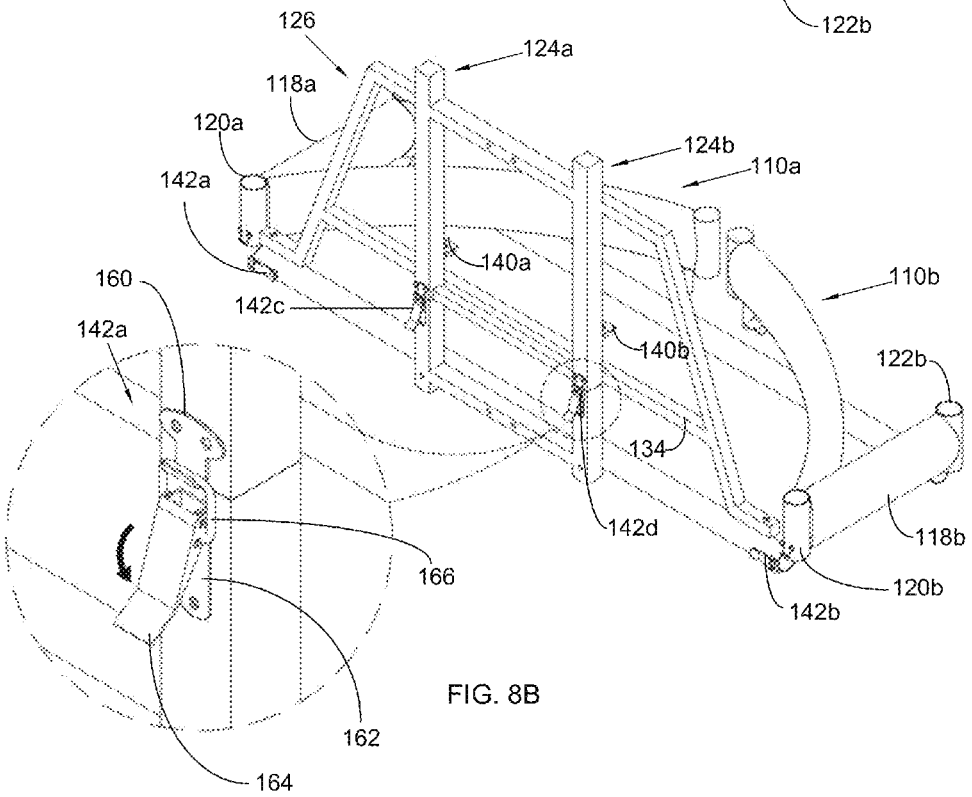

As shown in FIGS. 8A and 8B, the buckle hinge 142*a-d* pivotally connects the pair of first leg ends 104*a*, 104*b* with the base end 114*a*, 114*b* of the arched arms 110*a*, 110*b*. The buckle hinge 142*a-d* is further configured to selectively enable and restrict pivotal articulation between the pair of first leg 102 ends and the base end 114*a*, 114*b* of the arc portion 112*a*, 112*b* for the arched arms 110*a*, 110*b*.

Figure 9A:
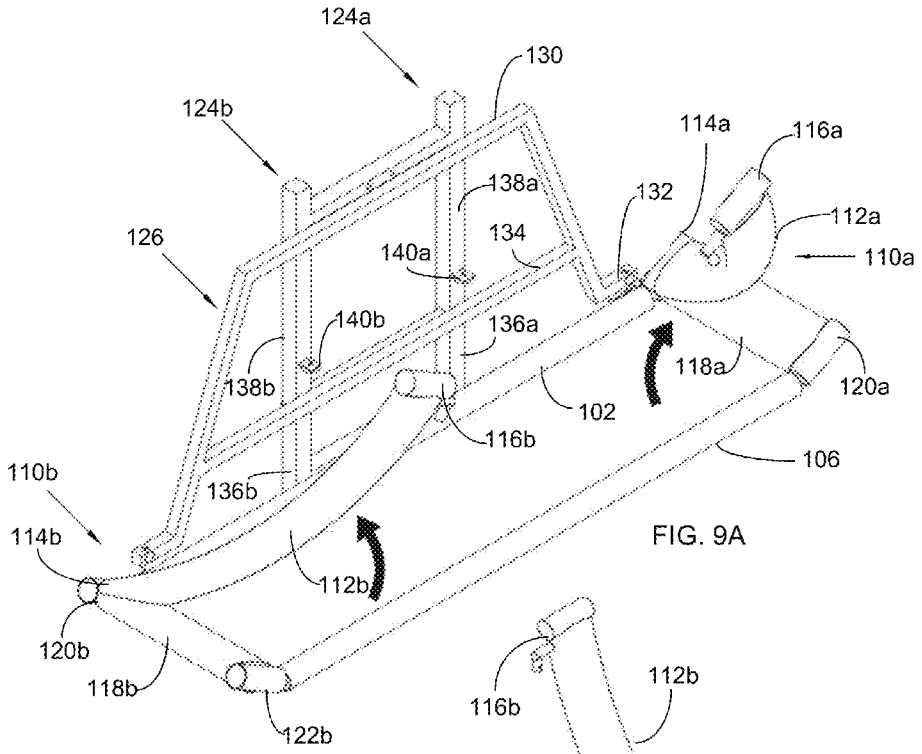
FIGS. 9A and 9B illustrate a perspective view of the arched shelf assembly with the pair of arched arms pivotally articulating from a collapsed position to an expanded position, in accordance with an embodiment of the present invention.

As FIG. 9A references, the buckle hinge 142*a-d* provides unique interconnectivity between the legs 102, 106 and arched arms 110*a*, 110*b* by enabling the pivotal articulation from a free position, and inhibiting the pivotal articulation from a locked position. Specifically, the buckle hinge 142*a-d* is used to fasten, connect, and pivot multiple sections of the assembly 100 relative to each other. In one embodiment, the buckle hinge 142*a-d* pivots up to 90°.

Figure 9B:
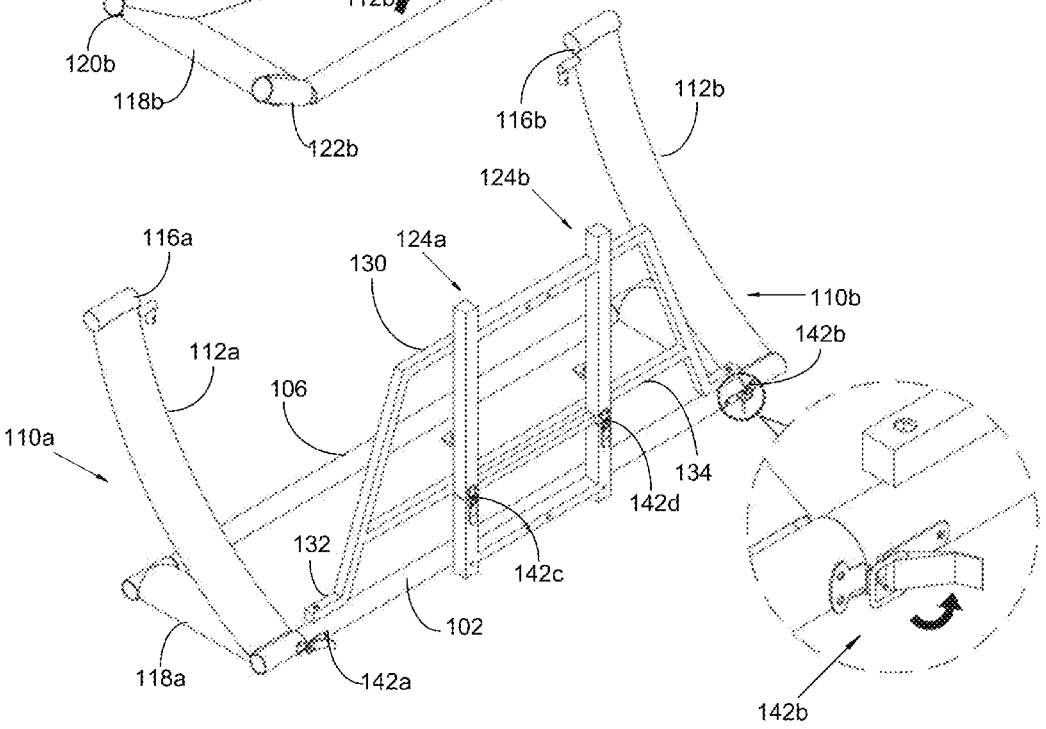

In one exemplary embodiment, the buckle hinge 142*a-d* pivotally connects the arched arms 110*a*, 110*b* with the legs 102, 106. In addition to the hinging function, the buckle hinge 142*a-d* is further configured to restrict pivotal articulation. The final expanded position of the assembly 100, which is shown in FIG. 9B, illustrates this. Thus, the assembly 100 can be locked into the expanded position for enhanced structural integrity, or unlocked into the collapsed position.

This unique capacity of the buckle hinge 142*a-d* to both enable and restrict pivotal articulation is possible because of the buckling mechanism. Specifically, the buckle hinge 142*a-d* is defined by a lip 160 and a latching member. The latching member comprises a mounting panel 162, a lever 164, and a catch 166. The lever 164 is configured to pivotally engage the catch 166 to the lip 160, wherein the lip 160 and the latching member detach and fasten through selective manipulation of the lever 164.

In operation of the buckle hinge 142*a-d*, the lever 164 is configured to pivot on the fulcrum selectively, to and from the lip 160, such that the catch 166 engages and disengages from the lip 160. Once the catch 166 clasps onto the generally protruding lip 160, a force is applied to the lever 164 away from the lip 160 to forcibly clamp the respective sections of the assembly 100 together. The direction of the lever 164 may then be reversed to disengage the catch 166 from the lip 160, and thereby enable separation of the respective sections of the assembly 100.

In one exemplary embodiment illustrated in FIG. 8B, the lip 160 is attached to the pair of first leg ends 104*a*, 104*b*, and the latching member is fastened to the base end 114*a*, 114*b* of the arc portion 112*a*, 112*b* from the pair of arched arms 110*a*, 110*b*. The latching member pivotally fastens and detaches from the lip 160 in a secure but adjustable manner. The lever 164 of the latching member is configured to pivot on a fulcrum to pivotally move the catch 166 and engage the lip 160. In this manner, the lip 160 catches and holds the latching member for detachable fastening.

Turning back to FIG. 3, the assembly 100 provides multiple, tiered surfaces for supporting a load. A first shelf detachably positions on at least one protrusion 140*a*, 140*b* extending from the support frame 126. A second shelf detachably positions on the at least one tab 168 of the arc portion 112*a*, 112*b* of the pair of arched arms 110*a*, 110*b*. A third shelf detachably positions on the base portion 118*a*, 118*b* of the pair of arched arms 110*a*, 110*b*. The shelves may be fabricated from tempered glass. Though other materials may be used.

In operation, the assembly 100 is easily collapsed for stowage and portab 168 ility. A first step for collapsing involves unlocking the buckle hinge 142*a-d* to enable pivotal articulation of the arched arms 110*a*, 110*b* about the legs. The hinges and barrel hinges are also pivotally articulated at the arched arms 110*a*, 110*b*, vertical shafts 124*a*, 124*b*, and the support frame 126. These components may then be folded inwardly to create the collapsed, substantially flat configuration of the assembly 100. The assembly 100 is opened to an expanded positon by unfolding the arched arms 110*a*, 110*b*, vertical shafts 124*a*, 124*b*, and support frame 126, and locking the buckle hinge 142*a-d*.

Thus, the assembly 100 is specially configured so that the arched arms 110*a*, 110*b*, vertical shafts 124*a*, 124*b*, and the support frame 126 are pivotally connected together with various hinges 142*a*, 144*a*, 146*a* and fasteners 158 so that they may be quickly assembled and also disassembled and returned to the collapsed position for further storage or shipment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An arched shelf assembly for carrying a load on multiple tiers and dispersing forces associated with the load, the assembly comprising:

a first leg, the first leg comprising a pair of first leg ends;

a second leg, the second leg comprising a pair of second leg ends, the second leg and the first leg disposed in a generally spaced-apart, parallel relationship;

a pair of arched arms, the pair of arched arms arranged in a generally spaced-apart, parallel relationship, the pair of arched arms defined by an arc portion having a generally arc shape, the arc shape configured to enhance structural integrity of the assembly, the arc portion defined by a base end and a shelf end, the pair of arched arms further defined by a base portion having a generally linear shape, the base portion comprising a first end and a second end, the first end of the base portion configured to fixedly join with the base end of the arc portion of the pair of arched arms, the first end and the second end of the base portion configured to pivotally join with the pair of first leg ends and the pair of second leg ends, whereby the pair of arched arms are configured to pivot between a lengthwise coplanar orientation and a generally perpendicular orientation relative to the first leg and the second leg;

at least one tab, the at least one tab configured to extend from the arc portion of the pair of arched arms;

a pair of vertical shafts, the pair of vertical shafts arranged in a generally spaced-apart, parallel relationship, the pair of vertical shafts defined by a first shaft end and a second shaft end, the first shaft end configured to fixedly join with the first leg, the pair of vertical shafts further defined by a hinged area disposed between the first shaft end and the second shaft end, the hinged area configured to enable pivoting articulation between the first shaft end and the second shaft end, whereby the pair of vertical shafts are configured to pivot between a traversal, coplanar orientation and a generally perpendicular orientation relative to the first leg and the second leg;

at least one protrusion, the at least one protrusion configured to extend from the pair of vertical shafts;

a support frame, the support frame defined by a pair of frame rods, a narrow end, and a wide end, the narrow end and the wide end configured to be generally perpendicular to the pair of frame rods, the narrow end configured to be generally shorter than the wide end, the narrow end further configured to pivotally join with the second shaft end of the pair of vertical shafts, the wide end configured to detachably attach to the shelf end of the arc portion for the pair of arched arms;

at least one hinge, the at least one hinge defined by a first hinge side configured to pivotally join with a second hinge side, the at least one hinge configured to pivotally connect the hinged area of the pair of vertical shafts, the at least one hinge further configured to pivotally connect the narrow end of the support frame with the second shaft end of the pair of vertical shafts;

at least one barrel hinge, the at least one barrel hinge defined by a first barrel side configured to pivotally join with a second barrel side, the at least one barrel hinge configured to pivotally connect the first end and the second end of the base portion with the pair of first leg ends and the pair of second leg ends;

at least one buckle hinge, the at least one buckle hinge configured to pivotally connect the first shaft end with the second shaft end, the at least one buckle hinge further configured to selectively enable and restrict pivotal articulation between the first shaft end and the second shaft end, the at least one buckle hinge further configured to pivotally connect the pair of first leg ends with the base end of the arc portion of the pair of arched arms, the at least one buckle hinge further configured to selectively enable and restrict pivotal articulation between the pair of first leg ends and the base end of the arc portion of the pair of arched arms;

a first shelf, the first shelf configured to detachably position on the support frame;

a second shelf, the second shelf configured to detachably position on the at least one tab of the pair of arched arms and the at least one protrusion of the pair of vertical shafts; and a third shelf, the third shelf configured to detachably position on the base portion of the pair of arched arms.

2. The assembly of claim 1, further including at least one fastener, the at least one fastener configured to detachably attach the wide end of the support frame to the shelf end of the arc portion of the pair of arched arms.

3. The assembly of claim 1, wherein the at least one fastener comprises a screw knob.

4. The assembly of claim 1, wherein the first shaft end is configured to fixedly join an approximately central area of the first leg.

5. The assembly of claim 1, wherein the first shelf, the second shelf, and the third shelf comprise tempered glass.

6. The assembly of claim 1, further including a cross bar, the cross bar configured to extend across the pair of frame rods of the support frame, the cross bar further configured to enhance structural integrity of the support frame.

7. The assembly of claim 1, wherein the at least one buckle hinge enables pivoting up to ninety degrees.

8. The assembly of claim 1, wherein the at least one hinge enables pivoting up to ninety degrees.

9. The assembly of claim 1, wherein the lip of the at least one buckle hinge enables passage of a screw for fastening the lip to the assembly.

10. The assembly of claim 1, wherein the at least one buckle hinge is defined by a lip and a latching member.

11. The assembly of claim 10, wherein the latching member comprises a mounting panel, a lever, and a catch, the lever configured to pivotally engage the catch to the lip, wherein the lip and the latching member detachably fasten.

12. The assembly of claim 11, wherein the mounting panel of the latching member enables passage of a screw for fastening the mounting panel to the assembly.

13. The assembly of claim 12, wherein the lever of the latching member pivots on a fulcrum.

14. The assembly of claim 13, wherein the catch is generally square-shaped.

15. An arched shelf assembly for carrying a load on multiple tiers and dispersing forces associated with the load, the assembly comprising:

a first leg, the first leg comprising a pair of first leg ends;

a second leg, the second leg comprising a pair of second leg ends, the second leg and the first leg disposed in a generally spaced-apart, parallel relationship;

a pair of arched arms, the pair of arched arms arranged in a generally spaced-apart, parallel relationship, the pair of arched arms defined by an arc portion having a generally arc shape, the arc shape configured to enhance structural integrity of the assembly, the arc portion defined by a base end and a shelf end, the pair of arched arms further defined by a base portion having a generally linear shape, the base portion comprising a first end and a second end, the first end of the base portion configured to fixedly join with the base end of the arc portion of the pair of arched arms, the first end and the second end of the base portion configured to pivotally join with the pair of first leg ends and the pair of second leg ends, whereby the pair of arched arms are configured to pivot between a lengthwise coplanar orientation and a generally perpendicular orientation relative to the first leg and the second leg;

at least one tab, the at least one tab configured to extend from the arc portion of the pair of arched arms;

a pair of vertical shafts, the pair of vertical shafts arranged in a generally spaced-apart, parallel relationship, the pair of vertical shafts defined by a first shaft end and a second shaft end, the first shaft end configured to fixedly join with the first leg, the pair of vertical shafts further defined by a hinged area disposed between the first shaft end and the second shaft end, the hinged area configured to enable pivoting articulation between the first shaft end and the second shaft end, whereby the pair of vertical shafts are configured to pivot between a traversal, coplanar orientation and a generally perpendicular orientation relative to the first leg and the second leg;

at least one protrusion, the at least one protrusion configured to extend from the pair of vertical shafts;

a support frame, the support frame defined by a pair of frame rods, a narrow end, and a wide end, the narrow end and the wide end configured to be generally perpendicular to the pair of frame rods, the narrow end configured to be generally shorter than the wide end, the narrow end further configured to pivotally join with the second shaft end of the pair of vertical shafts, the wide end configured to detachably attach to the shelf end of the arc portion for the pair of arched arms;

at least one fastener, the at least one fastener configured to detachably attach the wide end of the support frame to the shelf end of the arc portion of the pair of arched arms;

a cross bar, the cross bar configured to extend across the pair of frame rods of the support frame, the cross bar further configured to enhance structural integrity of the support frame;

at least one hinge, the at least one hinge defined by a first hinge side configured to pivotally join with a second hinge side, the at least one hinge configured to pivotally connect the hinged area of the pair of vertical shafts, the at least one hinge further configured to pivotally connect the narrow end of the support frame with the second shaft end of the pair of vertical shafts;

at least one barrel hinge, the at least one barrel hinge defined by a first barrel side configured to pivotally join with a second barrel side, the at least one barrel hinge configured to pivotally connect the first end and the second end of the base portion with the pair of first leg ends and the pair of second leg ends;

at least one buckle hinge, the at least one buckle hinge configured to pivotally connect the first shaft end with the second shaft end, the at least one buckle hinge further configured to selectively enable and restrict pivotal articulation between the first shaft end and the second shaft end, the at least one buckle hinge further configured to pivotally connect the pair of first leg ends with the base end of the arc portion of the pair of arched arms, the at least one buckle hinge further configured to selectively enable and restrict pivotal articulation between the pair of first leg ends and the base end of the arc portion of the pair of arched arms;

a first shelf, the first shelf configured to detachably position on the support frame;

a second shelf, the second shelf configured to detachably position on the at least one tab of the pair of arched arms and the at least one protrusion of the pair of vertical shafts; and a third shelf, the third shelf configured to detachably position on the base portion of the pair of arched arms.

16. The assembly of claim 15, wherein the at least one fastener comprises a screw knob.

17. The assembly of claim 15, wherein the at least one buckle hinge is defined by a lip and a latching member.

18. The assembly of claim 15, wherein the first shelf, the second shelf, and the third shelf comprise tempered glass.

19. The assembly of claim 15, wherein the at least one hinge enables pivoting up to ninety degrees.

20. An arched shelf assembly for carrying a load on multiple tiers and dispersing forces associated with the load, the assembly comprising:

a first leg, the first leg comprising a pair of first leg ends;

a second leg, the second leg comprising a pair of second leg ends, the second leg and the first leg disposed in a generally spaced-apart, parallel relationship;

a pair of arched arms, the pair of arched arms arranged in a generally spaced-apart, parallel relationship, the pair of arched arms defined by an arc portion having a generally arc shape, the arc portion defined by a base end and a shelf end, the pair of arched arms further defined by a base portion having a generally linear shape, the base portion comprising a first end and a second end, the first end of the base portion configured to fixedly join with the base end of the arc portion of the pair of arched arms, the first end and the second end of the base portion configured to pivotally join with the pair of first leg ends and the pair of second leg ends, whereby the pair of arched arms are configured to pivot between a lengthwise coplanar orientation and a generally perpendicular orientation relative to the first leg and the second leg;

a pair of vertical shafts, the pair of vertical shafts arranged in a generally spaced-apart, parallel relationship, the pair of vertical shafts defined by a first shaft end and a second shaft end, the first shaft end configured to fixedly join with the first leg, the pair of vertical shafts further defined by a hinged area disposed between the first shaft end and the second shaft end, the hinged area configured to enable pivoting articulation between the first shaft end and the second shaft end, whereby the pair of vertical shafts are configured to pivot between a traversal, coplanar orientation and a generally perpendicular orientation relative to the first leg and the second leg;

a support frame, the support frame defined by a pair of frame rods, a narrow end, and a wide end, the narrow end and the wide end configured to be generally perpendicular to the pair of frame rods, the narrow end configured to be generally shorter than the wide end, the narrow end further configured to pivotally join with the second shaft end of the pair of vertical shafts, the wide end configured to detachably attach to the shelf end of the arc portion for the pair of arched arms;

a first shelf, the first shelf configured to detachably position on the support frame;

a second shelf, the second shelf configured to detachably position between the arc portion of the pair of arched arms; and a third shelf, the third shelf configured to detachably position on the base portion of the pair of arched arms.

* * * * *